US006655057B2

(12) United States Patent
Kim

(10) Patent No.: US 6,655,057 B2
(45) Date of Patent: Dec. 2, 2003

(54) FRAMEWORK FOR A BALLOON DECORATION

(76) Inventor: Se Gon Kim, 500-61, Seodaeshin-dong 2ga, Seogu, Pusan (KR), 602-092

( * ) Notice: Subject to any disclaimer, the term of this patent is extended or adjusted under 35 U.S.C. 154(b) by 72 days.

(21) Appl. No.: 09/851,140

(22) Filed: May 9, 2001

(65) Prior Publication Data

US 2001/0045074 A1 Nov. 29, 2001

(30) Foreign Application Priority Data

May 9, 2000 (KR) ..... 2000-24541

(51) Int. Cl.[7] ..... G09F 21/06; E04H 12/00
(52) U.S. Cl. ..... 40/212; 52/655.2
(58) Field of Search ..... 40/212, 214, 605; 446/220, 223; 52/633, 648.1, 653.1, 655.2; 403/289, 290

(56) References Cited

U.S. PATENT DOCUMENTS 2,321,260 A * 6/1943 Stecher ..... 285/341
3,286,391 A * 11/1966 Mengeringhausen ..... 52/655.2
4,161,088 A * 7/1979 Gugliotta et al. ..... 52/655.2
4,438,615 A * 3/1984 Wendel ..... 52/655.2
4,606,562 A * 8/1986 Saraceno ..... 285/149.1
4,781,644 A * 11/1988 Yoshida ..... 52/655.2
4,866,902 A * 9/1989 Arciszewski ..... 52/655.2
4,905,443 A * 3/1990 Sutcliffe et al. ..... 52/655.2
4,941,856 A 7/1990 Lovik
5,036,985 A 8/1991 Lovik
5,353,570 A * 10/1994 Cooper, Jr. ..... 52/653.2
5,533,285 A * 7/1996 Skistimas et al. ..... 40/212
5,675,922 A 10/1997 Skistimas
5,755,419 A 5/1998 Gearhart et al.
5,769,685 A 6/1998 Nakamura et al.
5,904,258 A 5/1999 Farmer et al.
5,956,917 A * 9/1999 Reynolds ..... 52/655.2
6,019,660 A 2/2000 Luciano
6,050,874 A 4/2000 Ries

* cited by examiner

*Primary Examiner*—S. Joseph Morano
*Assistant Examiner*—Andrew Wright
(74) *Attorney, Agent, or Firm*—Jacobson Holman PLLC

(57) ABSTRACT

Disclosed is a framework for a balloon decoration capable of forming a balloon ornament at a predetermined shape by inserting a plurality of balloons into a space created between connecting rods of the framework. More particularly, this framework for the balloon decoration is mainly used for enhancing an effectiveness of advertisement at a ceremony to open a business or at a party held in celebration of an event. This framework can be fabricated such as a sectional toy and can be expressed as a variety of shapes adapted to further enhance the effectiveness of advertisement. According to the present invention, the framework for a balloon decoration includes a plurality of connecting balls (20) having a plurality of connecting holes (21) formed on a radial outer surface of the balls (20), and a connecting member (10) having a pair of connecting ends (13) and a connecting rod (11) extending between the connecting ends (13). A connecting protrusion (14) protrudes from an outer one side surface of the connecting end (13). The connecting protrusion (14) is adapted to be inserted into the connecting holes (21). It is possible to express a variety of shapes by optionally fabricating the connecting balls (20) and the connecting member (10).

4 Claims, 4 Drawing Sheets

【Fig 1】
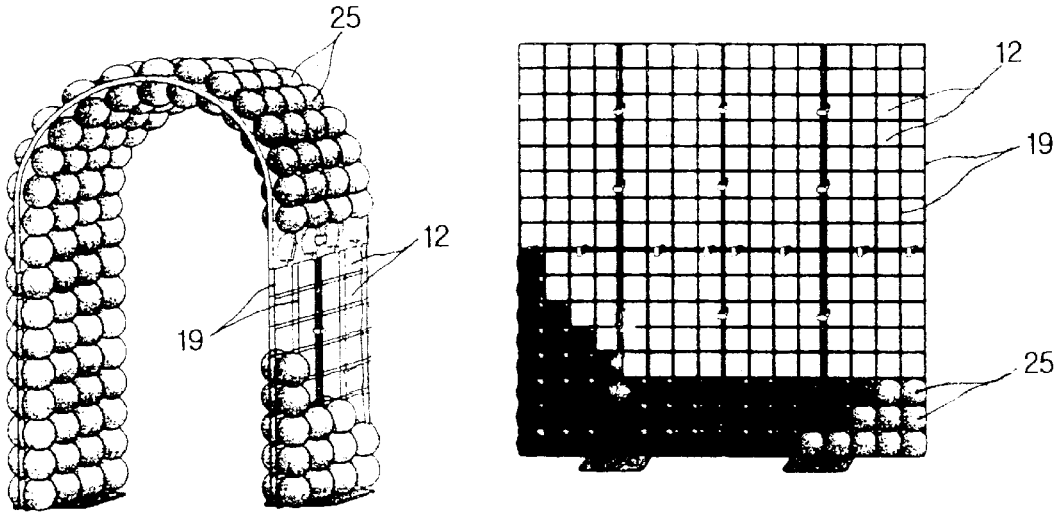
【Fig 2】
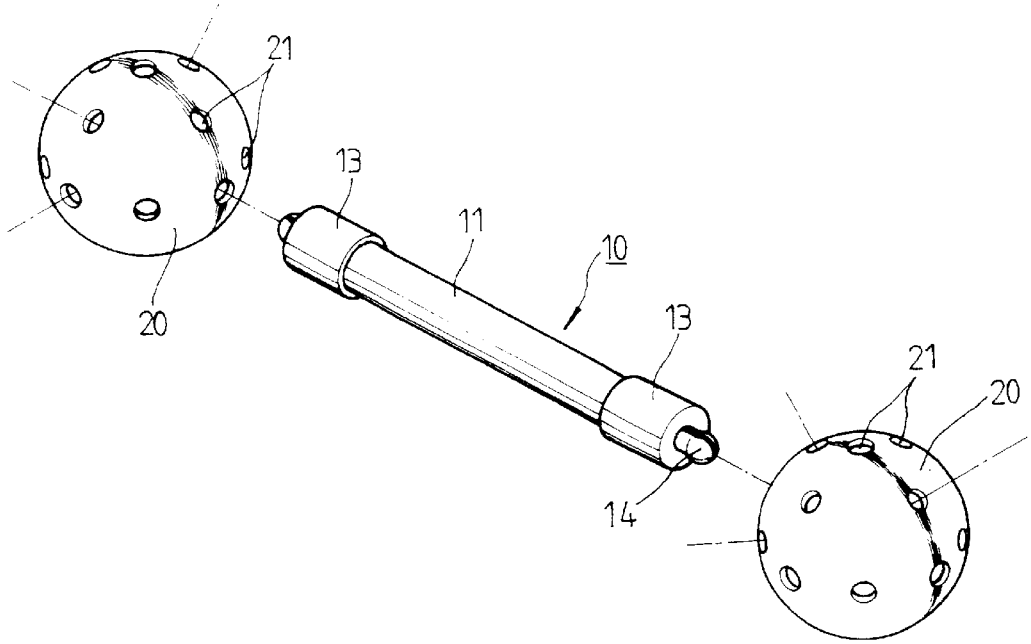

【Fig 3】
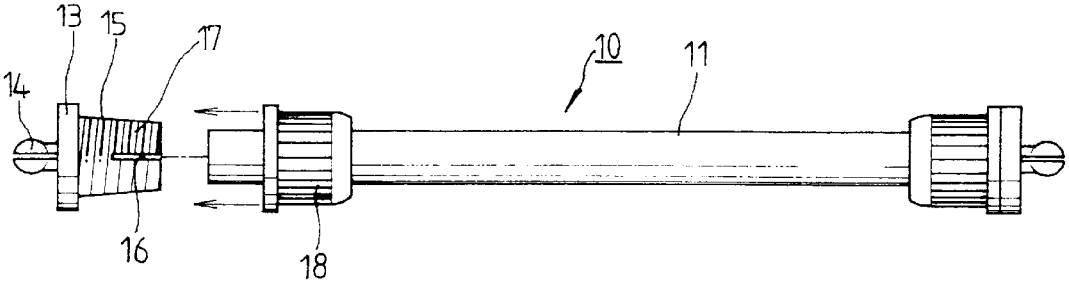
【Fig 4】
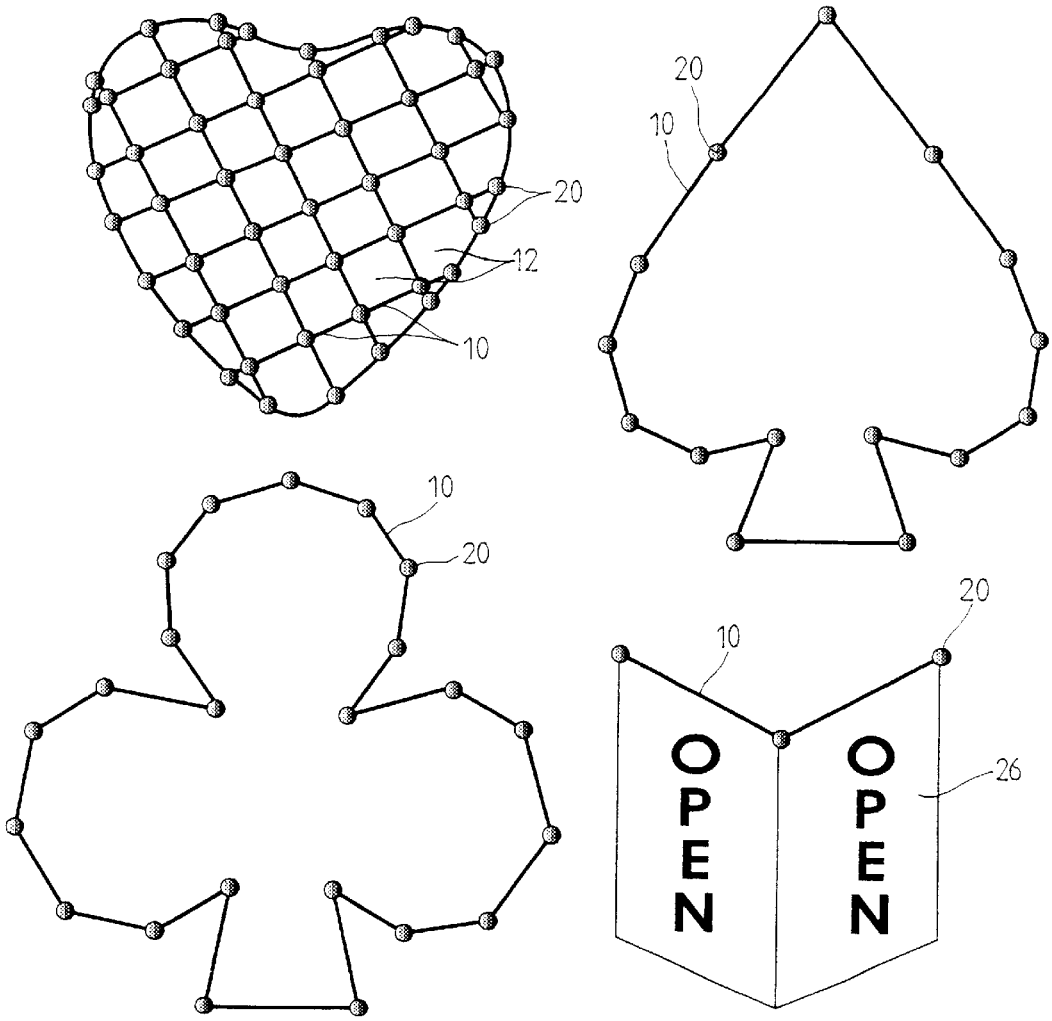

【Fig 5】
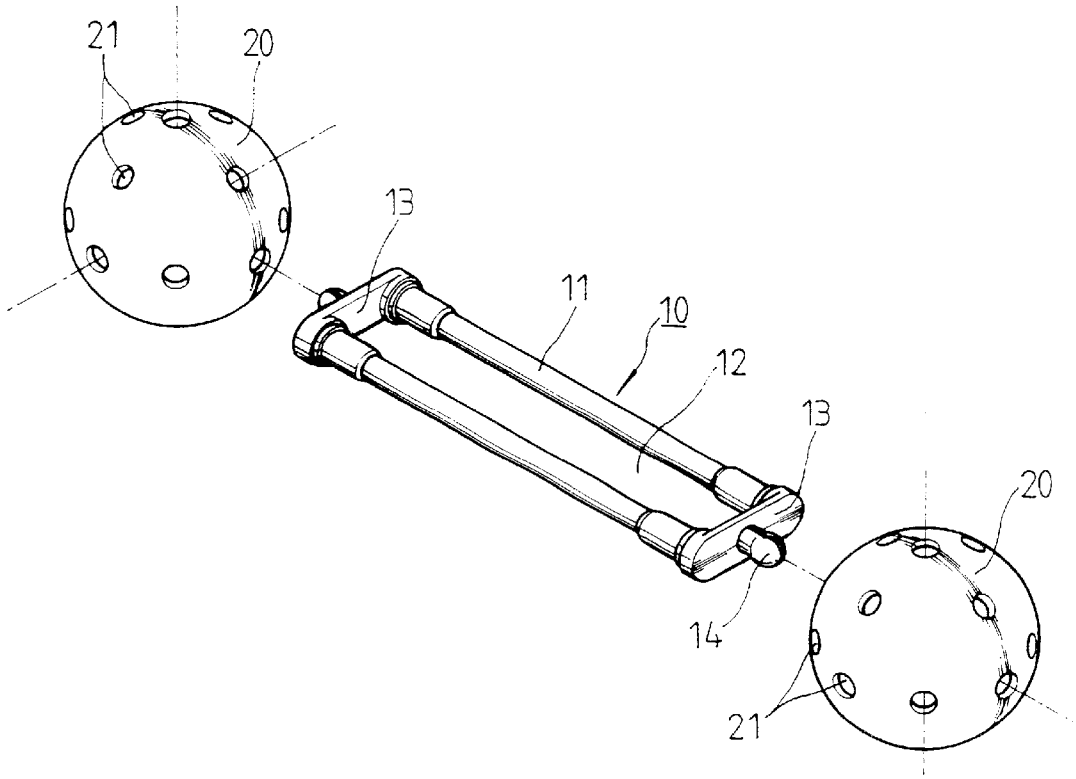
【Fig 6】
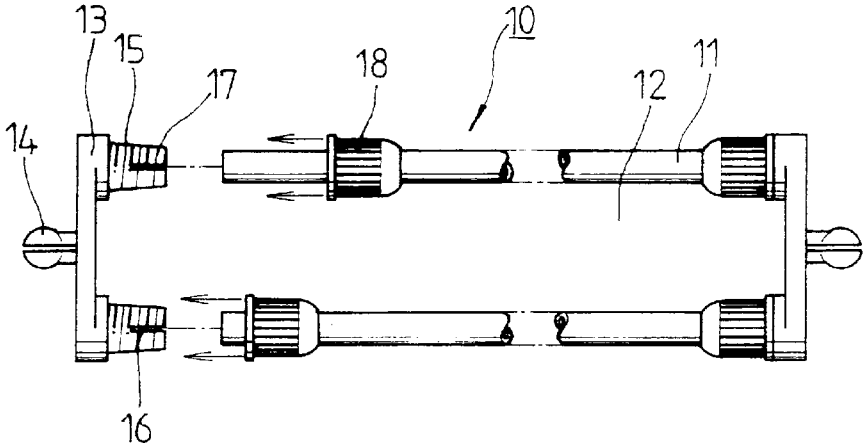

【Fig 7】
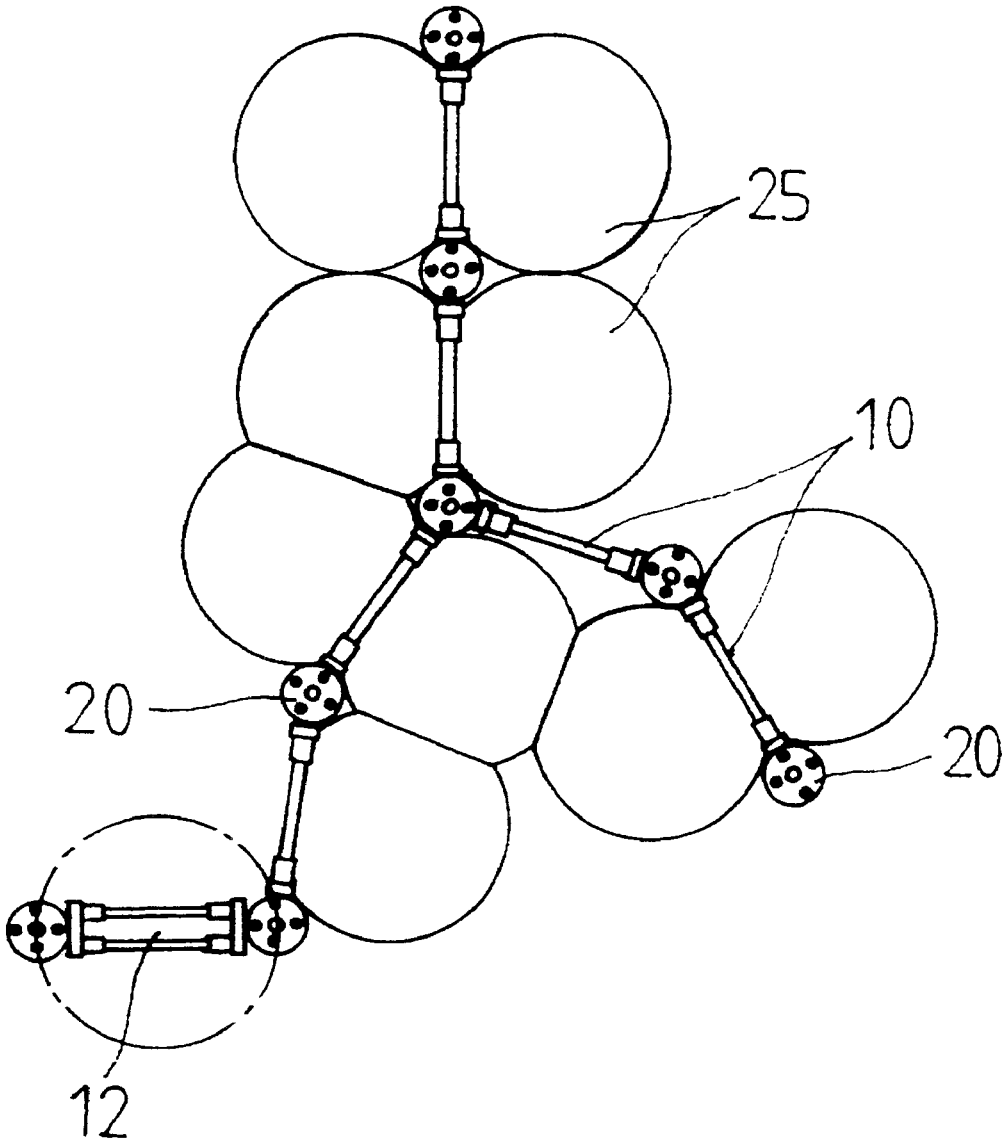

FRAMEWORK FOR A BALLOON DECORATION

BACKGROUND OF THE INVENTION

1. Field of the Invention

The present invention relates to a framework for a balloon decoration capable of forming a balloon ornament at a predetermined shape by inserting a plurality of balloons into a space created between connecting rods of the framework. More particularly, the present invention relates to a framework for a balloon decoration that is mainly used for enhancing an effectiveness of advertisement at a ceremony to open a business or at a party held in celebration of an event. This framework can be fabricated such as a sectional toy and can be expressed as a variety of shapes adapted to further enhance the effectiveness of advertisement.

2. Description of the Related Art

Generally, a balloon ornament having a variety of balloons is used for celebration at a ceremony to open a business or at a party held in celebration of an event. Since these balloons of the balloon ornament have various colors and shapes, any persons seeing these balloons can feel a sense of appreciation of the beautiful. Thereby, these balloons can attract public attention of the people. By reason of this, the demand for purchasing the balloon ornament is gradually increased.

The shape of the balloon ornament having an effectiveness of advertisement can be changed in accordance with a shape of a frame that is used for a balloon ornament.

FIG. 1 shows a process of production of a balloon ornament that is fabricated by using a frame for a balloon decoration.

As shown in FIG. 1, a plurality of frameworks (19) are engaged with one another at a lattice shape. At this time, a plurality of balloon fitted gaps (12) are created between the frameworks (19). When the frameworks (19) having the balloon fitted gaps (12) are produced at an arch shape or a quadrilateral shape, then a plurality of balloons are fitted into the balloon fitted gaps (12), and thereby a balloon ornament is created.

However, in the conventional frame for a balloon ornament, a plurality of frameworks (19) are fixedly engaged with one another and are rounded at need. Accordingly, a plurality of balloons are inserted into a plurality of balloon fitted gaps corresponding to the shapes of the frameworks (19). As a result, it is impossible to produce various shapes of the frames. Further, these frames are almost identical with other frames for a balloon decoration that are used for enhancing an effectiveness of advertisement at a ceremony to open a business or at a party held in celebration of an event. Consequently, the effectiveness of advertisement obtained from the conventional frame is not good.

SUMMARY OF THE INVENTION

The present invention is contrived to solve the foregoing problems. It is an object of the present invention to provide a framework for a balloon decoration capable of forming balloon ornaments at a variety of shapes and of enhancing an effectiveness of advertisement at a ceremony to open a business or at a party held in celebration of an event.

It is another object of the present invention to provide a frame work for a balloon decoration capable of enhancing an initiative spirit of the child during the application as a sectional toy.

In order to achieve the above object, the present invention provides a framework for a balloon decoration, the framework comprising:

a plurality of connecting balls having a plurality of connecting holes formed on a radial outer surface of the connecting balls; and a connecting member having a pair of connecting ends and a connecting rod extending between the connecting ends, in which the connecting ends includes a connecting protrusion protruding from an outer one side surface of the connecting end, respectively;

whereby the framework for a balloon decoration provides a variety of shapes by combining the connecting balls with the connecting member.

BRIEF DESCRIPTION OF THE DRAWINGS

The above object and other characteristics and advantages of the present invention will become more apparent by describing in detail a preferred embodiment thereof with reference to the attached drawings, in which:

FIG. 1 shows a process of production of a balloon ornament that is fabricated by using a frame for a balloon decoration;

FIG. 2 is an exploded perspective view of a frame for a balloon decoration according to a preferred first embodiment of the present invention;

FIG. 3 shows a process of combination of a connecting member that is a constitutional element of the frame for the balloon decoration according to the preferred first embodiment of the present invention;

FIG. 4 shows a variety of balloon ornaments which are produced by using the frame for the balloon decoration according to the preferred first embodiment of the present invention;

FIG. 5 is an exploded perspective view of a frame for a balloon decoration according to a preferred second embodiment of the present invention;

FIG. 6 shows a process of combination of a connecting member that is a constitutional element of the frame for the balloon decoration according to the preferred second embodiment of the present invention; and FIG. 7 shows a variety of balloon ornaments which are produced by using the frame for the balloon decoration according to the preferred second embodiment of the present invention.

DETAILED DESCRIPTION OF THE INVENTION

Hereinafter, a preferred embodiment of the present invention will be explained in more detail with reference to the accompanying drawings.

Referring to FIGS. 2 to 4, the framework for the balloon decoration according to the present invention mainly includes a plurality of connecting balls (20) and a connecting member (10). A plurality of connecting holes (21) are formed on a radial outer surface of the balls (20).

As shown in FIG. 2, the connecting member (10) includes a pair of connecting ends (13) and a connecting rod (11) extending between the connecting ends (13). At this time, the connecting ends (13) are fitted onto both ends of the connecting rod (11) by using a certain bonding agent. A connecting protrusion (14) protrudes from an outer one side surface of the connecting end (13), respectively. The connecting protrusion (14) is adapted to be inserted into the connecting holes (21). It is possible to express a variety of shapes by optionally combining the connecting balls (20) with the connecting member (10)

As shown in FIG. 3, a connecting portion (15) is formed at a rear part, which is opposite to a front part having the protrusion (14) in the connecting end (13) of the connecting member (10). The connecting rod (11) is engaged with the connecting portion (15). At least two cut-away grooves (16) having a predetermined length are formed at the connecting portion (15). A male screw thread (17) is formed at an outer periphery of the connecting portion (15).

The connecting rod (11) is inserted into the connecting portion (15) At this time, a connecting cap (18) is engaged with the connecting portion (15). The connecting cap (18) has a female screw thread(not shown) which is formed at a radial inner surface of the connecting cap (18). It is possible to replace the connecting rod (11) with another connecting rod (11) having a different length by releasing a combination of between the connecting portion (15) and the connecting cap (18).

According to the preferred first embodiment of the present invention, it is possible to create various shapes of framework for a balloon decoration by optionally combining the balloon with the connecting member as shown in FIG. 4.

Meanwhile, in the preferred second embodiment of the present invention as shown in FIGS. 5 to 7, a pair of connecting rods (11) are connected to connecting ends (13). The connecting rods (11) are spaced from each other at a predetermined distance. A pair of connecting portions (15) are formed at a rear part of the connecting ends (13), which is opposite to a front part having the protrusion (14) in the connecting ends (13) of the connecting member (10). A space for receiving a balloon (12) is created between the connecting rods (11).

Since constitutional elements in the framework for the balloon decoration according to the preferred second embodiment are identical to those of the framework for the balloon decoration according to the preferred first embodiment of the present invention, the descriptions of the same elements in the preferred second embodiment will be omitted.

Hereinafter, the operation of the framework for a balloon decoration according to the second embodiment the present invention will be described in detail.

The framework for a balloon decoration mainly includes the connecting member (10) and the connecting balls (20). The connecting balls (20) have a plurality of connecting holes (21) which are formed on a radial outer surface of the connecting balls (20). The connecting member (10) extends between the connecting balls (20) and has a variety of lengths. A connecting protrusion (14) protrudes from an outer one side surface of the connecting end (13), respectively. The connecting protrusion (14) is adapted to be inserted into the connecting holes (21).

It is possible to express a variety of shapes by optionally combining the connecting balls (20) with the connecting member (10). In other words, it is possible to express two-dimensional shape or three-dimensional shape by using the framework for a balloon decoration.

FIG. 4 shows a variety of balloon ornaments which are produced by using the frame for the balloon decoration according to the preferred first embodiment of the present invention.

As shown in FIG. 4, it is possible to create balloon ornaments such as a heart shape, a spade shape or a clover shape.

In order to create these shapes of balloon ornaments, the connecting member (10) having the protrusion (14) in the connecting end (13) thereof is disposed between the connecting balls (20). A desired shape of balloon ornament is created by inserting the protrusion (14) into the connecting holes (21) with considering a predetermined shape.

After forming a predetermined circumference by inserting the protrusion (14) of the connecting member (10) into the connecting holes (21) of the connecting balls (20) with considering a predetermined shape, the connecting balls (20) are engaged with the connecting member (10) at a net shape within the circumference, and thereby the heart shape of balloon ornament can be created.

Since forming processes of the spade shape or the clover shape of balloon ornament are identical to the forming process of the heart shape of balloon ornament, the descriptions of the above forming processes will be omitted.

After forming the frame for the balloon decoration, as shown in the heart shape of the frame, a plurality of balloons are inserted into a plurality of balloon fitted gaps (12) which are formed by the combination of between connecting member (10) and the connecting balls (20) at a net shape. Thereby, it is possible to fabricate and to install the frame for the balloon decoration as a desired shape.

Meanwhile, a size of the balloon to be inserted into the balloon fitted gaps (12) must be greater than the size of the gaps (12). Accordingly, the expanded balloon is inserted into the balloon fitted gaps (12).

The size of the balloon fitted gaps (12) is dependent to the length of the connecting member (10) at the time that the balloon is inserted into the gaps (12). Since the size of the balloon is greater than that of the gaps (12) due to the expansion of the balloon, a part of the balloon is pressed during the balloon's insertion into the balloon fitted gaps (12). As a result, the balloon is elastically constricted due to the application of the pressure. At this time, the other part of the balloon expands in correspondence with the constriction of the balloon. Consequently, the balloon is fixedly inserted into the balloon fitted gaps (12).

As shown in FIGS. 5 and 6, in the preferred second embodiment of the present invention, a desired shape of balloon ornament is created by optionally engaging the connecting member (10) with the connecting balls (20). Since a part of the expanded balloon is filled in the balloon fitted gaps (12) of between the connecting rods (11) during the balloon's insertion into the space, the balloon is fixedly inserted into the balloon fitted gaps (12). Further, it is possible to insert a small balloon or an elongated balloon into an aperture provided between the balloon and the balloon fitted gaps (12).

The balloon ornaments are created as the shapes, that is a heart shape, a spade shape or a clover shape, which are shown in FIG. 4. Since the protrusion (14) of the connecting member (10) is inserted into the connecting holes (21) of the connecting balls (20), it is possible to form a three-dimensional shape of the frame for a balloon ornament. For example, it is possible to fabricate the frame for a balloon ornament in a state that a part of the frame is partially protruded from the front side or the rear side of the frame that is fabricated as a plane shape. At this time, a space for receiving the balloon is created at a position adjacent to the protruding part of the frame.

Since various shapes of the frame for a balloon ornament can be created, it is possible to enhance the effectiveness of advertisement.

Also, as shown in FIG. 4, it is possible to produce a hanging banner by using the connecting balls (20) and the elongated connecting member (10). At this time, various shapes of placards (26) can be installed by hanging the balloon with the hanging banner. As a result, it is possible to enhance the effectiveness of advertisement.

If the frame for balloon ornament is used as a sectional toy, it is possible to enhance an initiative spirit of the child.

As described above, the frame for a balloon ornament according to the present invention can be produced as various shapes. Thereby, it is possible to enhance the effectiveness of advertisement by using this frame for a balloon ornament. In other words, it is possible to express the effectiveness of advertisement for enhancing an effectiveness of advertisement at a ceremony to open a business or at a party held in celebration of an event.

Further, this framework can be fabricated such as a sectional toy and then it is possible to enhance an initiative spirit of the child.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A framework for a balloon decoration, the framework comprising:

a plurality of connecting balls having a plurality of connecting holes formed on a radial outer surface of the connecting balls;

a connecting member having a pair of connecting ends and a connecting rod extending between the connecting ends, in which the connecting ends include a connecting protrusion protruding from an outer one side surface thereof, respectively for combining the connecting balls with the connecting member;

a connecting portion being formed at a rear part opposite to a front part which has the connecting protrusion in the connecting end of the connecting member;

at least two cut-away grooves having a predetermined length being formed at the connecting portion;

a male screw thread being formed at an outer periphery of the connecting portion;

a connecting cap being engaged with the connecting portion; and the connecting rod being replaced with another connecting rod having a different length by releasing the engagement between the connecting portion and the connecting cap.

2. The framework as claimed in claim 1, wherein the connecting rod is spaced from another connecting rod, and a space for receiving a plurality of balloons is created between the connecting rods.

3. A framework for a balloon decoration to form a balloon ornament of predetermined shapes by inserting a plurality of balloons into spaces created by said framework, comprising:

a plurality of connecting balls, each of said balls having a plurality of connecting holes, each of said connecting holes formed on a radial outer surface of the ball;

at least one connecting member including a pair of connecting ends and a connecting rod, said connecting rod extending between the connecting ends;

a connecting protrusion protruding from an outer side surface of each of said connecting ends, said connecting protrusion being adapted to be inserted into one of said plurality of connecting holes for forming a variety of said predetermined shapes by fabricating the connecting balls and the connecting member, a predetermined circumference being formed by inserting the protrusion of the connecting member into the connecting holes of the connecting balls, the connecting balls being engaged with the connecting member to form said predetermined shapes within the circumference, the plurality of balloons being inserted into a plurality of balloon fitted gaps which are formed by connecting the connecting member and the connecting balls, with a size of the balloon to be inserted into the balloon fitted gaps being greater than the size of the gaps, wherein an expanded balloon is inserted into the balloon fitted gaps and the size of the balloon fitted gaps is dependent on a length of the connecting member at a time when the balloon is inserted into the gaps, the size of the balloon being greater than that of the gaps due to the expansion of the balloon, and a part of the balloon being pressed during insertion into the balloon fitted gaps to elastically constrict the balloon due to an application of pressure.

4. The framework as claimed in claim 3, wherein said predetermined shapes include a heart shape, a spade shape or a clover shape.

* * * * *